US005603259A

United States Patent [19]

Gross et al.

[11] Patent Number: 5,603,259

[45] Date of Patent: Feb. 18, 1997

[54] IN-LINE COLD FOIL TRANSFER PROCESS AND APPARATUS

[75] Inventors: Leonard B. Gross, Teaneck; Manuel S. Cueli, Clifton, both of N.J.

[73] Assignees: Crown Roll Leaf, Inc.; Adhesion Systems, Inc., both of Paterson, N.J.

[21] Appl. No.: 481,847

[22] Filed: Jun. 7, 1995

Related U.S. Application Data

[62] Division of Ser. No. 114,764, Aug. 31, 1993, abandoned.

[51] Int. Cl.[6] ..... B41D 7/00

[52] U.S. Cl. ..... 101/33; 156/233

[58] Field of Search ..... 101/34, 33; 156/233, 156/234, 235, 239, 241, 277

[56] References Cited

U.S. PATENT DOCUMENTS

| | | | |
|---|---|---|---|
| 3,458,376 | 7/1969 | Malik | 156/233 |
| 3,480,500 | 7/1969 | Malik | 156/233 |
| 3,654,016 | 4/1972 | Alexander | 156/247 |
| 3,980,512 | 9/1976 | Rauser | 156/231 |
| 4,012,552 | 3/1977 | Watts | 428/200 |
| 4,215,170 | 7/1980 | Oliva | 428/328 |
| 4,250,209 | 2/1981 | de Leeuw et al. | 427/250 |
| 4,288,275 | 9/1981 | Davis | 156/367 |
| 4,374,691 | 2/1983 | Vanden Bergh | 156/234 |
| 4,382,831 | 5/1983 | Clough et al. | 156/94 |
| 4,388,137 | 6/1983 | McCarty et al. | 156/275.5 |
| 4,465,538 | 8/1984 | Schmoock | 156/233 |
| 4,484,970 | 11/1984 | Burzlaff et al. | 156/233 |
| 4,524,104 | 6/1985 | Hagio et al. | 428/341 |
| 4,581,320 | 4/1986 | Kreiter | 430/320 |
| 4,701,235 | 10/1987 | Mitsam | 156/233 |
| 4,724,026 | 2/1988 | Nelson | 156/233 |
| 4,868,049 | 9/1989 | Nelson | 428/328 |
| 4,869,767 | 9/1989 | Robinson et al. | 156/233 |
| 4,902,364 | 2/1990 | Parker et al. | 156/233 |
| 4,902,546 | 2/1990 | White | 428/40 |
| 4,904,325 | 2/1990 | Crass et al. | 156/233 |
| 4,994,131 | 2/1991 | Edwards | 156/233 |
| 5,069,954 | 12/1991 | Cole et al. | 428/202 |
| 5,135,798 | 8/1992 | Muschter et al. | 428/202 |

FOREIGN PATENT DOCUMENTS

| | | |
|---|---|---|
| 56-55282 | 5/1981 | Japan . |
| 3130783 | 1/1988 | Japan . |
| 1020395 | 1/1989 | Japan . |
| 1-145187 | 6/1989 | Japan . |

*Primary Examiner*—Ren Yan

*Attorney, Agent, or Firm*—Woodcock Washburn Kurtz Mackiewicz & Norris

[57] ABSTRACT

An improved apparatus and method employ a printing press which normally includes a plurality of printing stations and a plurality of heating stations. An adhesive, rather than ink, is applied to a continuous web at at least one of the printing stations and heat is subsequently applied to the web at at least one of the heating stations in order to initiate curing of the adhesive. Roll leaf is pressed against the web with a pressure sufficient to transfer colored (i.e., metallic or non-metallic) material from the roll leaf to the adhesive which has been applied to the web and which is undergoing curing.

14 Claims, 2 Drawing Sheets

IN-LINE COLD FOIL TRANSFER PROCESS AND APPARATUS

This is a division of application Ser. No. 08/114,764, filed Aug. 31, 1993, now abandoned.

FIELD OF THE INVENTION

The present invention relates to the application of roll leaf to a substrate, such as a web of paper, foil laminated to paper, or film, in a continuous process without the use of heat to accomplish the roll leaf transfer.

BACKGROUND OF THE INVENTION

There is a need to print metallized patterns of gold or silver on substrates, such as webs of paper, foils laminated to paper, and films. Metallized ink has been used to accomplish this by utilizing a conventional ink printing press. However, metallized ink lacks the lustre of other metallized sources, such as roll leaf. Thus, it has become necessary to use the roll leaf transfer techniques discussed below to create more desirable metallized patterns on such substrates.

Roll leaf is a very thin, laminated product with an outer transparent polyester film carrier which has a release coat made from wax, filicone or resins. Next, a colored or clear lacquer is applied to the release coat, followed by an application of a vacuum metallized layer. The last layer is a size coat or primer which functions to protect the metallized layer and as an adhesive during a transfer operation. Roll leaf is, in effect, colored foil.

A common technique for applying roll leaf involves feeding it into an apparatus which is in the form of a press having a steel plate adapted to transfer the colored foil to a substrate by way of pressure and heat The colored foil is placed over a surface to which it is to be applied, a heated platen with a die consisting of the design to be applied is pressed onto the foil, and the impact of the die transfers the foil to the substrate on only those portions of the foil where the die has been applied. This technique is commonly referred to as "hot stamping".

Many commercial products are typically provided with multi-colored decorations or labeling in an effort to catch the eye of a consumer. Because metallic colon afford a stylish, if not expensive, look, it is common practice to provide multi-colored decorations and labeling with metallic colon as well as with non-metallic colon. In the past, such multi-colored decorations and labeling have been produced using a hybrid process consisting of a conventional printing operation, utilized to apply a non-metallic ink, and a conventional hot stamping operation, utilized to apply metallic foil. Because the hot stamping operation is carried out separate from the printing operation, the hybrid process is not performed in an in-line manner. As a result, normal priming press operating speeds must be significantly reduced in order to accommodate the slower throughput rates of standard hot stamping machines, whereby the overall processing time is increased and the overall production rate is decreased. Rotary hot presses have been developed which can be operated in line with a conventional printing operation. While eliminating the intermittent operating pauses associated with the use of conventional non-rotary hot stamping machines, these rotary hot presses operate at line speeds which are slower than those of conventional printing operations, whereby the overall processing time is still increased and the overall production rate is still decreased. Rotary hot presses are also disadvantageous because they require the use of heat and they are expensive.

In addition to the stamping methods described above, various cold-foil transfer methods have been proposed. These methods are not, however, carried out in-line on an otherwise conventional printing press. Rather, known cold-foil trier methods have made use of high pressure presses and drums (see U.S. Pat. No. 4,484,970); a two-step manual foil applying process (see U.S. Pat. No. 4,994,131); and a xerographic process (see U.S. Pat. No. 4,868,049).

SUMMARY OF THE INVENTION

The present invention relates to an improved apparatus and method employing a printing press which normally includes a plurality of printing stations for applying ink to a continuous web and a plurality of heating stations for generating enough heat to substantially dry ink applied to the web. In accordance with one aspect of the improvement, an adhesive, rather than ink, is applied to the web at at least one of the printing stations and heat is subsequently applied to the web at at least one of the heating stations in order to initiate curing of the adhesive. In accordance with another aspect of the improvement, roll leaf is pressed against the web with a pressure sufficient to transfer colored (i.e., metallic or non-metallic) material from the roll leaf to the adhesive which has been applied to the web and which is undergoing curing, such pressing being carried out in line and without the application of heat.

BRIEF DESCRIPTION OF THE DRAWINGS

For a more complete understanding of the present invention, reference may be had to the following detailed description of an exemplary embodiment considered in conjunction with the accompanying drawings, in which.

DETAILED DESCRIPTION OF THE EXEMPLARY EMBODIMENT

Figure 1:
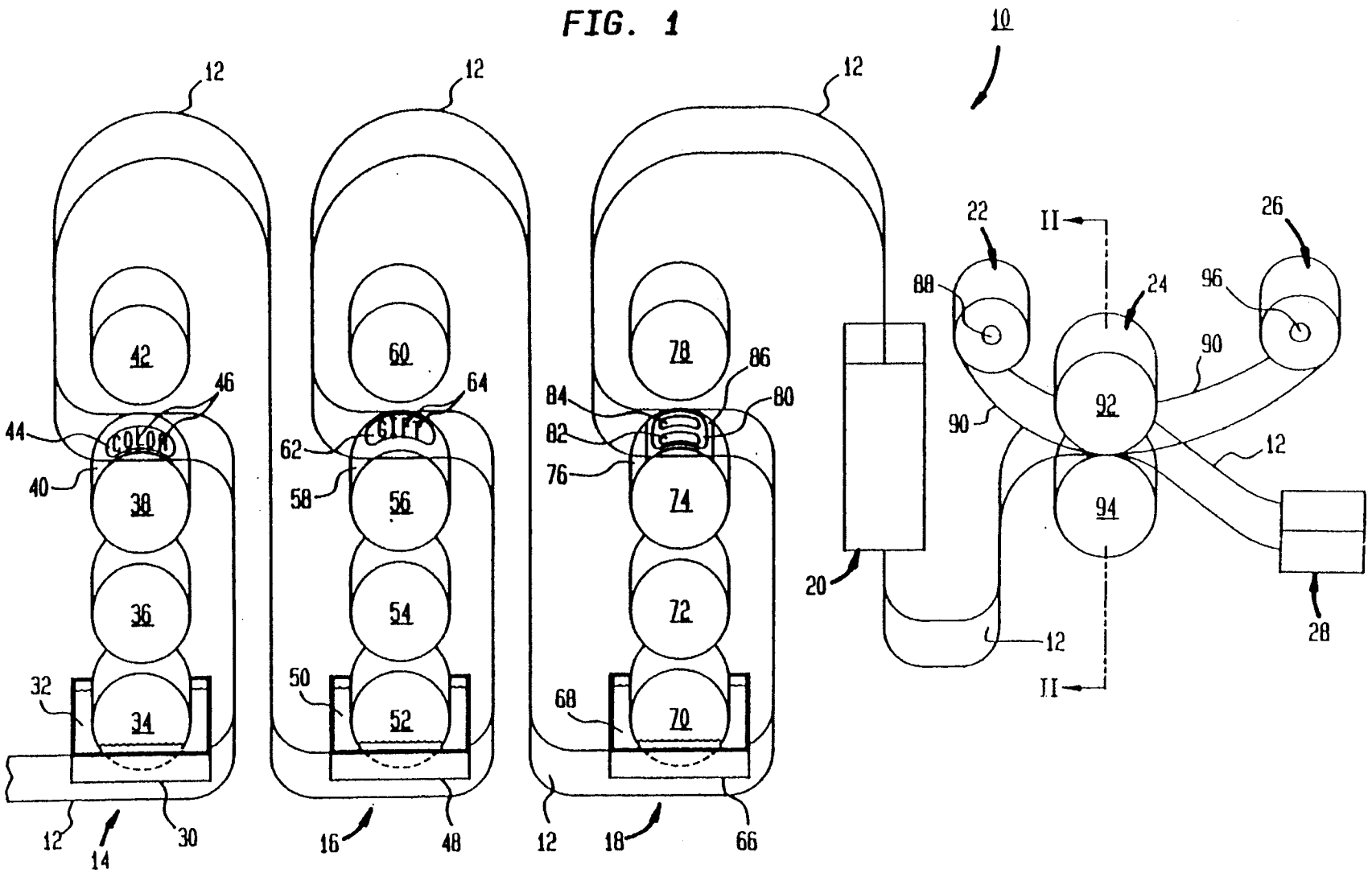
FIG. 1 schematically illustrates an apparatus for transferring foil to a substrate in accordance with one exemplary embodiment of the present invention.

Referring to FIG. 1, there is shown a continuous label making apparatus 10 which is adapted to make a plurality of labels on a continuous web 12 of label stock or film. The apparatus 10 includes a plurality of priming stations (i.e., a first printing station 14, an intermediate printing station 16, and a last printing station 18); a heating station 20; a roll leaf supply station 22; a roll leaf transfer station 24; a roll leaf take-up station 26; and a web wind-up station 28.

The first printing station 14 includes a tray 30 which contains an ink 32 of a first predetermined color, a pickup roller 34, a gravure 36, a flex-o-roller 38, a flex-o-plate 40, and a pressure roller 42. The flex-o-plate 40 contains an area ,14, which is raised so that it will accept the ink 32, and indentations 46, which form the word "COLOR" and which are recessed so they will not accept the ink 32. Alternatively, the flex-o-plate 40 could contain a raised pattern to be inked and a recessed surrounding area (i.e., the word "COLOR" would be raised and the area 44 would be recessed). A standard heat tunnel (not shown) would be interposed between the first printing station 14 and the intermediate printing station 16 to dry the ink 32 applied to the web 12 before the ink 32 gets to the intermediate printing station 16.

The intermediate printing station 16 includes a tray 48 which contains an ink 50 of a second predetermined color, a pickup roller 52, a gravure 54, a flex-o-roller 56, a fin-o-plate 58, and a pressure roller 60. The flex-o-plate 58 contains an area 62, which is raised so that it will accept the ink 50, and indentations 64, which form the word "GIFT" and which are messed so they will not accept the ink 50. Alternatively, the flex-o-plate 58 could contain a raised pattern to be inked and a recessed surrounding area (i.e., the word "GIFT" would be raised and the area 62 would be recessed). A standard heat tunnel (not shown) would be interposed between the intermediate printing station 16 and the last printing station 18 to dry the ink 50 applied to the web 12 before the ink 50 gets to the last printing station 18.

The last printing station 18 is exactly like the first printing station 14 and the intermediate printing station 16, except that it includes a tray 66 which contains an adhesive 68 rather than ink. The last printing station 18 also includes a pickup roller 70, a gravure 72, a flex-o-roller 74, a flex-o-plate 76, and a pressure roller 78. The flex-o-plate 76 contains an area 80, which is raised so that it will accept the adhesive 68, and inner indentations 82, 84 and an outer indentation 86, all of which are recessed so they will not accept the adhesive 68. The inner indentations 82, 84 have shapes that complement the outer configurations of the areas ,14, 62, respectively, for a purpose to be described hereinafter, while the outer indentation 86 has a shape whose purpose will also be described hereinafter.

The adhesive 68 contained in the tray 66 is a water-based, self cross-linking copolymer substance that cures in ambient conditions. The adhesive 68 also does not exhibit cold flow, the advantage of which will be described hereinafter.

The heating station 20 includes a standard heat tunnel (not shown) which is normally part of a conventional printing press and which is therefore like the heat tunnel (not shown) interposed between the first printing station 14 and the intermediate printing station 16 as well as the heat tunnel (not shown) interposed between the intermediate printing station 16 and the last printing station 18. The temperature of the heating station 20 typically ranges from about 250 degrees F. to about 400 degrees F.

The supply station 22 includes a spool 88 which contains roll leaf 90. The roll leaf 90, which is stored on the spool 88 in the form of a roll, has characteristics which are standard in the roll leaf industry.

The transfer station 24 includes a pair of unheated pinch rollers 92, 94. Each of the pinch milers 92, 94 can be made from a high durometer robber (i.e., in a range from about 80 durometer to about 95 durometer.) Alternatively, one metal roller and one high durometer robber roller can be used. It is also possible to use two metal rollers.

The take-up station 26 includes a spool 96 which receives the roll leaf 90 as it leaves the transfer station 24. The spool 96 may be driven so that the roll leaf 90 is wound onto the spool 96 in the form of a roll.

The wind-up station 28 includes a standard curing mechanism (not shown) which divides the web 12 into individual pieces after the web 12 passes through the transfer station 24. In the exemplary embodiment shown, each of the pieces constitutes a separate label (see FIG. 3.)

In operation, the web 12 is fed into and through the apparatus 10 at a continuous and constant speed, which for a narrow press is typically in a range of from about 150 feet to about 300 feet per minute. The web 12 passes through the first printing station 14 and the intermediate printing station 16 in a conventional flexographic printing press manner.

At the first printing station 14, the pickup roller 34 transfers the ink 32 from the tray 30 to the gravure 36, which collects and meters out a predetermined mount of the ink 32 and supplies the ink 32 to the raised area 44 on the flex-o-plate 40 as the flex-o-plate 40 rotates conjointly with the flex-o-roller 38. As the web 12 passes between the flex-o-roller 38 and the pressure roller 42, the raised area 44 of the flex-o-plate 40, which area now contains the ink 32, comes into contact with the web 12 and creates an ink pattern thereon, which pattern matches the shape of the raised area 44. For each revolution of the flex-o-roller 38, a corresponding ink pattern is created on the web 12. Thus, repeated revolutions of the flex-o-roller 38 create a series of spaced apart patterns of the ink 32 on the web 12, which patterns are dried as the web 12 passes through the heat tunnel (not shown) interposed between the fast printing station 14 and the intermediate printing station 16.

At the intermediate printing station 16, the pickup roller 52 transfers the ink 50 from the tray 48 to the gravure 54, which collects and meters out a predetermined mount of the ink 50 and supplies the ink 50 to the raised area 62 on the flex-o-plate 58 as the flex-o-plate 58 rotates conjointly with the flex-o-roller 56. As the web 12 passes between the flex-o-roller 56 and the pressure roller 60, the raised area 62 of the flex-o-plate 58, which area now contains the ink 50, comes into contact with the web 12 and creates an ink pattern thereon, which pattern matches the shape of the raised area 62. For each revolution of the flex-o-roller 56, a corresponding ink pattern is created on the web 12. Thus, repeated revolutions of the flex-o-roller 56 create a series of spaced apart patterns of the ink 50 on the web 12, each pattern having a predetermined positional relationship relative to a corresponding one of the patterns formed by the ink :32. The patterns formed by the ink 50 are dried as the web 12 passes through the heat tunnel (not shown) interposed between the intermediate printing station 16 and the last printing station 18.

The web 12 is fed into the last printing station 18 at the same line speed or feed rate as the previous (i.e., conventional) printing stations. At the last printing station 18, the pickup roller 70 transfers the adhesive 68 from the tray 66 to the gravure 72, which collects and meters out a predetermined amount of the adhesive 68 and supplies the adhesive 68 to the raised area 80 on the flex-o-plate 76 as the flex-o-plate 76 rotates conjointly with the flex-o-roller 74. As the web 12 passes between the flex-o-roller 74 and the pressure roller 78, the raised area 80 of the flex-o-plate 76, which area now contains the adhesive 68, comes into contact with the web 12 and creates an adhesive pattern thereon, which pattern matches the shape of the raised area 80. For each revolution of the flex-o-roller 74, a corresponding adhesive pattern is created on the web 12. Thus, repeated revolutions of the flex-o-roller 74 create a series of spaced apart patterns of the adhesive 68 on the web 12, each pattern having a predetermined positional relationship relative to the corresponding patterns formed by the ink 32 and the ink 50. During the adhesive applying process, the adhesive 68 on the flex-o-roller 74 rewets itself because of its water soluble characteristics, thereby allowing the adhesive 68 to be applied very cleanly and accurately.

The web 12 is next passed through the heating station 20, which functions to evaporate water contained in the adhesive 68 that has been applied to the web 12, thereby drying the adhesive and initiating a curing process, which continues under ambient conditions. As the adhesive 68 undergoes drying, it "sets" so as to deter running beyond the boundaries of the adhesive pattern described above.

Figure 2:
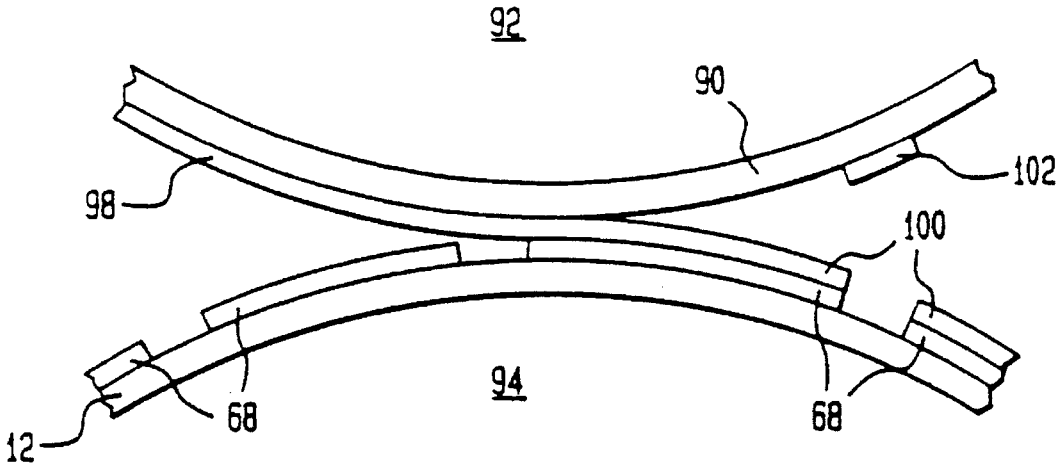
FIG. 2 is a partial cross sectional view taken along section line II—II of FIG. 1 and schematically depicting an in-line cold-foil transfer station which forms a part of the apparatus illustrated in FIG. 1.

At the transfer station 24, the web 12, still traveling at the constant line speed or feed rate referred to above, is fed between the pinch rollers 92, 94, along with the roll leaf 90 which is fed from the supply station 22. As illustrated in FIG. 2, the pinch rollers 92, 94 generate a force sufficient to cause a size-coated metallic layer 98 of the roll leaf 90 to adhere to the adhesive 68 on the web 12 without the application of heal Upon contacting the metallic layer 98 of the roll leaf 90, the adhesive 68 bonds thereto and strips the metallic layer 98 from the roll leaf 90 when the roll leaf 90 and the web 12 are separated, thereby creating metallized designs 100 on the web 12 in the shape of the adhesive patterns formed by the adhesive 68. Also adhering to the web 12 is a clear protective coating or lacquer (not shown) of the metallic layer 98. Portions 102 of the metallic layer 98 that do not contact the adhesive 68 continue to adhere to the roll leaf 90 when the roll leaf 90 is separated from the web 12. The roll leaf 90 exiting the transfer station 24 continues on to the take-up station 26 where the roll leaf 90, with the portions 102 of the metallic layer 98 still adhering thereto, is wound up onto the spool 96.

Figure 3:
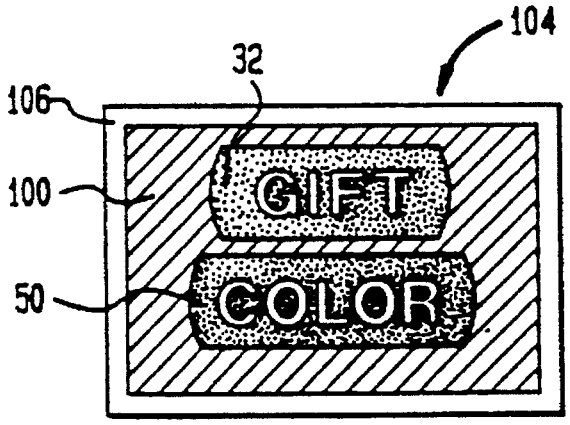
FIG. 3 is a top plan view of a label manufactured using the apparatus illustrated in FIGS. 1 and 2.

As the web 12 exits the transfer station 24, it continues on to the wind-up station 28 where the web 12 is die-cut into individual pieces, each of which represents a label 104 (see FIG. 3). The adhesive curing process, which was initiated at the heating station 20, now continues on each piece under ambient conditions. Because the adhesive 68 does not exhibit cold flow, cracking of the metallized designs 100 on the web 12 is inhibited.

Referring now to FIG. 3, the label 104 includes the word "COLOR", which is uncolored (i.e., it is the same color as the web 12 because none of the ink 32 was applied to the indentations 46 on the flex-o-plate 40) and which is surrounded by one of the patterns formed by the ink 32. Similarly, the label 104 includes the word "GIFT", which is uncolored (i.e., it is the same color as the web 12 because none of the ink 50 was applied to the indentations 64 on the flex-o-plate 58) and which is surrounded by one of the patterns formed by the ink 50. The label 104 also includes one of the metallized designs 100, which surrounds the ink patterns on the label 104 and which is framed by an uncolored and non-metallized border 106 corresponding, in shape, to the outer indentation 86 on the flex-o-plate 76.

It will be understood that the embodiment described herein is merely exemplary and that a person skilled in the art may make many variations and modifications without departing from the spirit and scope of the invention. For example, while the adhesive 68 is applied at the last printing station 18, it could just as well be applied at any of the other printing stations (i.e., at the first printing station 14 or at the intermediate printing station 16). Moreover, while flexographic printing is illustrated at each of the stations 14, 16 and 18, the printing could be accomplished by a gravure applicator or cylinder, or lithographically. It is also possible to replace the metallic layer 98 of the roll leaf 90 with a non-metallic layer. Thus, all such variations and modifications are intended to be included within the scope of the invention as defined in the appended claims.

We claim:

1. In a printing apparatus which normally includes a plurality of printing stations for applying ink to a continuous web and a plurality of heating stations for generating enough heat to substantially dry ink applied to the web, the improvement wherein at least one of said printing stations applies a water-based, self-cross-linking co-polymer adhesive to the web that cures in ambient conditions and does not exhibit cold flow, wherein at least one of said heating stations applies heat sufficient only to initiate curing of the adhesive which has been applied to the web; said improvement also comprising a roll leaf disposed downstream of said one printing station, unheated pinch rollers arranged in-line with said printing stations and said heating stations, for pressing the roll leaf against the web with a pressure sufficient to transfer colored material from the roll leaf to the adhesive which has been applied to the web and which is undergoing curing, the transfer of the colored material being carried out continuously without the application of heat at a constant speed between 150–300 feet/minute.

2. The apparatus of claim 1, wherein each of said pinch rollers is made from a high durometer rubber.

3. The apparatus of claim 2, wherein each of said pinch rollers has a durometer in a range of from about 80 durometer to about 95 durometer.

4. The apparatus of claim 1, wherein one of said pinch rollers is made from a high durometer rubber and the other of said pinch rollers is made from metal.

5. The apparatus of claim 4, wherein said one roller has a durometer in a range of from about 80 durometer to about 95 durometer.

6. The apparatus of claim 1, wherein each of said pinch rollers is made from metal.

7. The apparatus of claim 1, wherein the roll leaf is fed at the same line speed as the web.

8. The apparatus of claim 7, wherein the roll leaf is fed from a supply spool to a take-up spool.

9. The apparatus of claim 1, wherein said adhesive rewets itself.

10. The apparatus of claim 1, wherein said at least one printing station is a last printing station.

11. The apparatus of claim 10, wherein at least another of said printing stations applies ink to the web.

12. The apparatus of claim 11, wherein said at least another of said printing stations includes a first printing station.

13. The apparatus of claim 12, wherein said at least another of said printing stations includes an intermediate printing station.

14. The apparatus of claim 1, wherein said colored material has a metallic color.

* * * * *

UNITED STATES PATENT AND TRADEMARK OFFICE

CERTIFICATE OF CORRECTION

PATENT NO. : 5,603,259

DATED : February 18, 1997

INVENTOR(S) : Gross

It is certified that error appears in the above-indentified patent and that said Letters Patent is hereby corrected as shown below:

Col. 1, line 36, after "heat" insert a period --.--;
Col. 1, line 45, delete "colon" and insert therefor --colors--;
Col. 1, line 55, delete "priming" and insert therefor --printing;
Col. 2, line 62, delete ",14" and insert therefor --44--;
Col. 3, line 30, delete ",14 and insert therefor --44--;
Col. 3, line 51, delete "milers" and insert therefor --rollers--;
Col. 4, line 38, delete ":32" and insert therefor --32--;
Col. 5, line 12, delete "heal" and insert therefor --heat--.

Signed and Sealed this

Eighth Day of July, 1997

Bruce Lehman

*Attest:*

BRUCE LEHMAN

*Attesting Officer*

*Commissioner of Patents and Trademarks*